US007185377B2

(12) United States Patent
Roussy

(10) Patent No.: US 7,185,377 B2
(45) **Date of Patent: *Mar. 6, 2007**

(54) HEIGHT ADJUSTABLE BED AND AUTOMATIC LEG STABILIZER SYSTEM THEREFOR

(75) Inventor: Richard Brian Roussy, London (CA)

(73) Assignee: Invacare Corporation, Elyria, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/171,950

(22) Filed: Jun. 30, 2005

(65) Prior Publication Data

US 2005/0283912 A1 Dec. 29, 2005

Related U.S. Application Data

(63) Continuation of application No. 10/380,875, filed as application No. PCT/CA01/01362 on Sep. 28, 2001, now Pat. No. 6,920,656.

(60) Provisional application No. 60/236,388, filed on Sep. 29, 2000.

(51) Int. Cl.
*A61G 7/012* (2006.01)

(52) U.S. Cl. ..... 5/611; 5/86.1

(58) Field of Classification Search ..... 5/611, 5/86.1; 16/19, 32, 34; 296/20
See application file for complete search history.

(56) References Cited

U.S. PATENT DOCUMENTS 1,999,106 A 4/1935 Muller
2,675,285 A 4/1954 Terry et al.

(Continued)

FOREIGN PATENT DOCUMENTS

DE 199 15 670 10/2000

(Continued)

OTHER PUBLICATIONS

PCT International Search Report completed Apr. 9, 2002, for PCT/CA01/01362, International Filing Date Sep. 28, 2001.

(Continued)

*Primary Examiner*—Michael Trettel
(74) *Attorney, Agent, or Firm*—Calfee, Halter & Griswold, LLP

(57) ABSTRACT

A vertically adjustable mechanical bed consisting of a bed frame for support of a mattress and occupant attached to moveable leg means powered by a motor means. Operation of the motor means causes a bearing block attached to the leg means to move longitudinally along a guide rod means, thereby collapsing the leg means beneath the bed and moving the bed frame vertically. Collapsing the bed to its substantially lowermost position causes the bearing block to engage a spring, thereby compressing said spring between the bearing block and a transverse member of the bed frame. The energy stored by the compression of the spring is used to raise the bed from its substantially lowermost position. Pivotally attached to the leg means is a rolling means consisting of a caster and foot arrangement. During normal operation, the foot is firmly engaged with the floor surface. When the bed frame moves to its substantially uppermost position, a pin extending from the leg means and constrained in a slot on a flanged face of the rolling means engages one end of the slot, thereby causing the rolling means to pivot and the caster to engage the floor, rendering the bed horizontally mobile.

12 Claims, 3 Drawing Sheets

U.S. PATENT DOCUMENTS

| | | | |
|---|---|---|---|
| 3,203,010 | A | 8/1965 | Smith |
| 3,305,876 | A | 2/1967 | Hutt |
| 3,676,881 | A | 7/1972 | Duprey |
| 4,503,844 | A | 3/1985 | Siczek |
| 5,245,718 | A | 9/1993 | Krauska |
| 5,257,428 | A | 11/1993 | Carroll et al. |
| 5,347,682 | A | 9/1994 | Edgerton, Jr. |
| 5,432,966 | A | 7/1995 | Berta et al. |
| 5,438,723 | A | 8/1995 | Carroll |
| 5,594,961 | A | 1/1997 | Yokoi et al. |
| 5,720,059 | A | 2/1998 | Allevato et al. |
| 6,230,344 | B1 | 5/2001 | Thompson et al. |
| 6,405,393 | B2 | 6/2002 | Megown |
| 6,473,921 | B2 | 11/2002 | Brooke et al. |
| 6,601,251 | B2 | 8/2003 | Paul |

FOREIGN PATENT DOCUMENTS

| | | |
|---|---|---|
| EP | 558108 | 8/1996 |
| EP | 1155670 | 11/2001 |
| FR | 2704143 | 10/1994 |
| FR | 2769832 | 4/1999 |
| GB | 1084020 | 9/1967 |
| WO | WO 01/74286 | 10/2001 |

OTHER PUBLICATIONS

Advertisement for Joerns Ultra Care Universal Bed Care (Sunrise Medical, 1999).

Advertisement for Eurocare Bed, (Kokuyo).

Maxxum Series Low Bed, Advertising Brochure (M.C. Healthcare Products Inc., Jan. 2003).

HEIGHT ADJUSTABLE BED AND AUTOMATIC LEG STABILIZER SYSTEM THEREFOR

This application is a continuation of U.S. application Ser. No. 10/380,875, filed Mar.19, 2003, now U.S. Pat. No. 6,920,656, which is based on International Application No. PCT/CA01/01362 filed Sep. 28, 2001, which is based on U.S. Provisional Application No. 60/236,388 filed Sep. 29 , 2000, This application claims the benefit of the filing date of all said prior applications, and incorporates by reference the subject matter of all said prior applications.

FIELD OF THE INVENTION

The present invention relates to improvements in a vertically adjustable mechanical bed.

BACKGROUND OF THE INVENTION

A vertically adjustable mechanical bed may be lowered or raised as required by an operator by means of motor activation. The bed is used in its "lower most positions" to minimize the risk of injury to persons who may through inattention or infirmity fall out of the bed. The lower the height, the less risk of injury. The bed is used in its "upper most" positions to enable personnel to perform their functions with respect to the bed or its occupant without bending down or having to work in an awkward physical position.

FR 2,704,143 discloses a bed having a frame comprising floor engaging surfaces. The bed has scissors legs with rollers mounted to extensions of the legs. The floor engaging surfaces are part of the bed frame and are not mounted to the legs with the rollers.

FR 2,769,832 discloses a bed having roller feet and means to vary the height of the bed.

SUMMARY OF THE INVENTION

One aspect of the present invention is to provide the bed with a foot/caster leg arrangement which enables the bed to remain in a stable or non mobile condition on the floor surface resting on the foot portion of the leg over almost the entire range of vertical travel. As the bed frame reaches its upper most point, the novel foot/caster leg arrangement of the present invention will automatically pivot onto the caster portion of the leg which permits mobility. The bed according to the present invention is almost always in the stable position resting on the foot portion through almost the entire range of vertical travel. At about prior to the highest position, the bed becomes mobile as the weight of the bed is transferred onto the casters that have automatically come into contact with the floor or ground as hereinafter described.

According to another aspect of the invention, the bed frame may be elevated or lowered using the described linkage mechanisms and arrangements such that the bed frame moves vertically over the same "footprint". In other words, the bed frame moves upwardly or downwardly without any longitudinal or horizontal component of travel. One of the advantages associated with this type of "straight up and down" feature is that the end of the bed frame immediately adjacent, for example, a wall, will not move away from the wall or into the wall with the consequent possibility of property damage or personal injury.

The present invention in one embodiment provides a bed, having a bed frame and a pair of motor powered leg means operable to vertically raise and lower the bed frame between a lowermost and an uppermost position, the leg means including rolling means, the rolling means comprising a fixed leg member, the fixed leg member engaging the floor when the bed frame is in the lowermost position and disengaging the floor when the bed frame is raised to thereby render the bed horizontally mobile on the rolling means only at substantially the uppermost position.

The present invention in yet another embodiment provides a bed frame comprising a pair of spaced apart transverse frame elements inward of each end of the bed frame, having a pair of rod guide means therebetween-rigidly connected at each end to said transverse frame elements. The guide means have a bearing element and a spring element circumferentially mounted thereon. The bearing element is movable along the length of the guide means to engage as well as to compress the spring element at one end thereof against said transverse frame element and wherein the motor power consists of a linear actuator operatively attached to the bearing element.

The present invention in yet another embodiment provides leg means comprising a substantially inverted U shaped leg frame member having a pair of downwardly extending legs, collapsibly attached to the underside of said bed frame by means of a first pinned connection at the top thereof between the leg frame and the bearing element and a second pinned linkage connection between one end of the bed frame and substantially the midpoint of the leg frame member.

The present invention In yet another embodiment provides rolling means comprising a flange having a slot therethrough and opposite ends, said flange rotatably attached to the bottom of each said leg of the leg frame member and constrained to rotationally pivot with respect thereto by means of a pin member extending from the bottom of each said leg passing through said slot, each said opposite end having attached thereto respectively a fixed leg member and a caster member. The slot in the flange has a convex arcuate shape with reference to the floor surface. Each of said downwardly extending legs may be rigidly connected at its bottom end by a transverse leg frame member and said rolling means may be optionally rotationally attached to said transverse leg frame member.

The present invention in yet another embodiment provides a bed, having a bed frame and a pair of motor powered leg means operable to vertically raise and lower said bed frame over a range of heights between a lowermost and uppermost position. The bed frame comprises a pair of spaced apart transverse frame elements inward of each end of the bed frame, having a pair of rod guide means therebetween rigidly connected at each end to said transverse frame elements, said guide means having a bearing element and a spring element, said bearing element movable along the length of the guide means to engage as well as to compress the spring element at one end thereof against said transverse frame element. The motor power consists of a linear actuator operatively attached to the bearing element to thereby move said bearing element longitudinally along said guide means. The leg means comprises a substantially inverted U shaped leg frame member having a pair of downwardly extending legs, collapsibly attached to the underside of said bed frame by means of a first pinned connection at the top thereof between the leg frame and the bearing element and a second pinned linkage connection between one end of the bed frame and substantially the midpoint of the leg frame member. Castor wheels may be attached to the bottom of each leg.

Further features of the invention will be described or will become apparent in the course of the following detailed description.

BRIEF DESCRIPTION OF THE DRAWINGS

In order that the invention may be more clearly understood, a preferred embodiment thereof will now be described in detail by way of example, with reference to the accompanying drawings, in which.

PREFERRED EMBODIMENT

Figure 1:
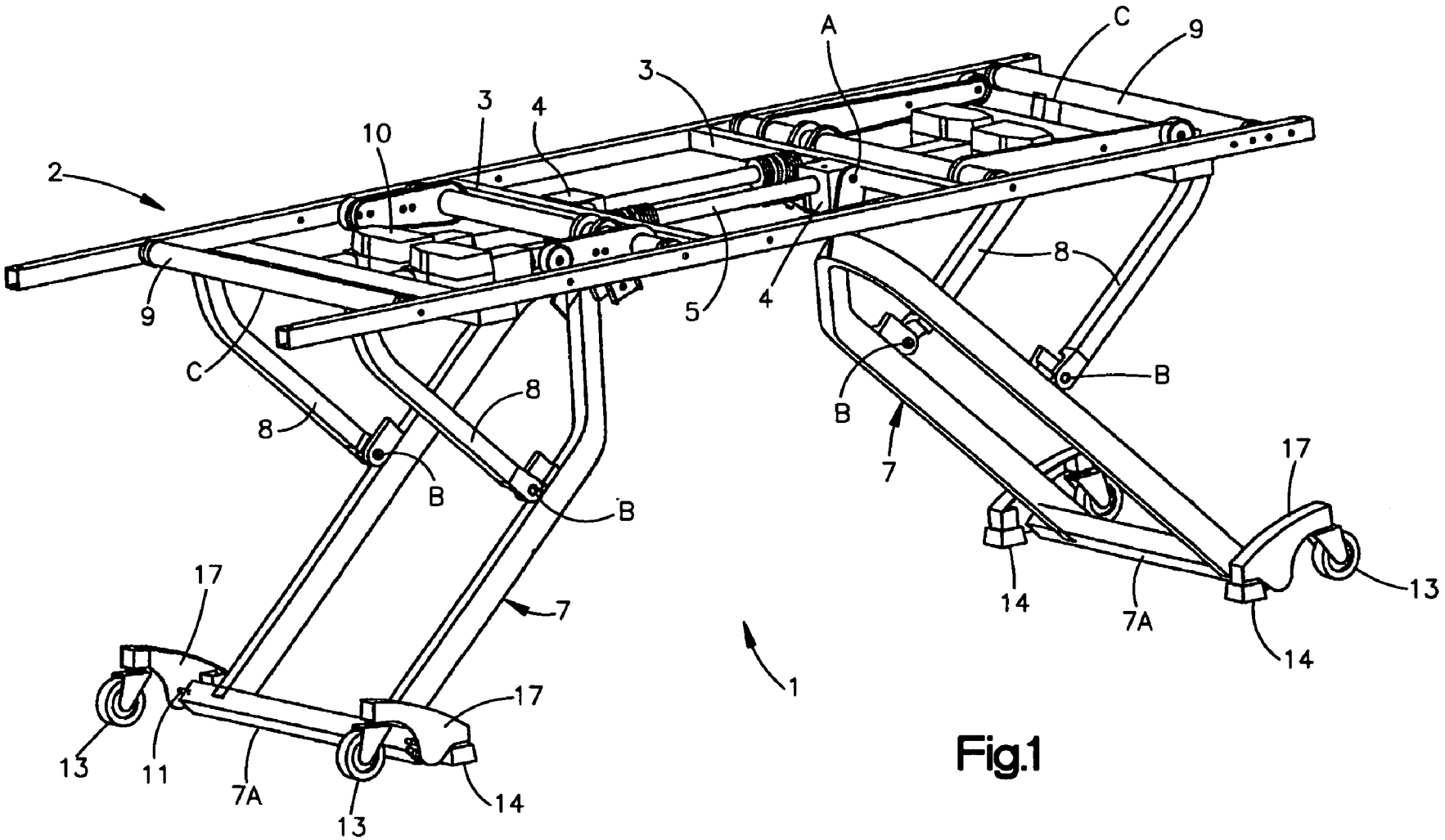
FIG. 1 is a perspective view of the mechanical bed frame and leg arrangement shown in the highest position.

Referring to FIG. 1, a vertically adjustable bed 1 is shown having a rectangular like bed frame 2 which has cross members 3 and 9 which gives the bed frame its rigidity.

The leg arrangement associated at each end of the bed consists of a inverted U shaped main leg frame member 7 which is pivotally and movably attached to the bed frame by means of bearing block 4 at pivot point A. This arrangement allows the top of the leg frame member 7 to follow the bearing block as it travels longitudinally along the linear guide 5 in response to the movement of a linear actuator associated with the motor means 10. The bearing block consists of a square like block having a circular aperture therethrough. The operation of the motor moves the bearing block 4 by means of the linear actuator longitudinally along the linear guide rod 5. This action causes the main frame leg to collapse and lower or extend and rise under the bed.

Returning to the leg arrangement, the main leg frame member 7 is pivotally attached at its mid point B to one end of a linkage arm 8. The other end of the linkage arm 8 is fixedly attached at C to a rotatable sleeve on cross member 9. It should be noted that the pivot points A, B and C are equidistant from one another which permits the vertical up and down motion of the bed in response to the movement of the bearing block along the linear guide by means of the linear actuator. In operation, the movement of the bearing block along the linear guide rod 5 will either rotationally collapse or raise the main leg.

One problem with raising a bed from its lowermost position is the greater motor power required to initiate the raising sequence action. This is because there is no effective angle θ between the main leg frame member 7 and the bed frame 2 as shown in FIG. 1. When collapsed, the main leg frame member 7 is tucked under the bed frame and is virtually parallel thereto. The angle θ is effectively zero. For this reason, spring members 6 are provided at each end of the linear guide rod mounted circumferentially thereon and optionally fixedly attached to one of the transverse cross-members 3 as shown or to the bottom of the leg. Referring to the earlier description of the operation of the bed, when lowering the bed the front face of the bearing block 4 will eventually come into contact with and engage the spring 6. Further lowering action will cause the spring 6 to longitudinally compress between the bearing block and the transverse cross-member. Full compression occurs at the lowermost position. When the bed is sought to be raised the energy in the compressed spring 6 acts on the front face of the bearing block 4 to initiate the first or initial movement along the linear guide rod without reliance on the motor at this most critical point. Once movement has been started by the spring and an effective angle θ established, the motor is able to take over to easily raise the bed.

Figure 2:
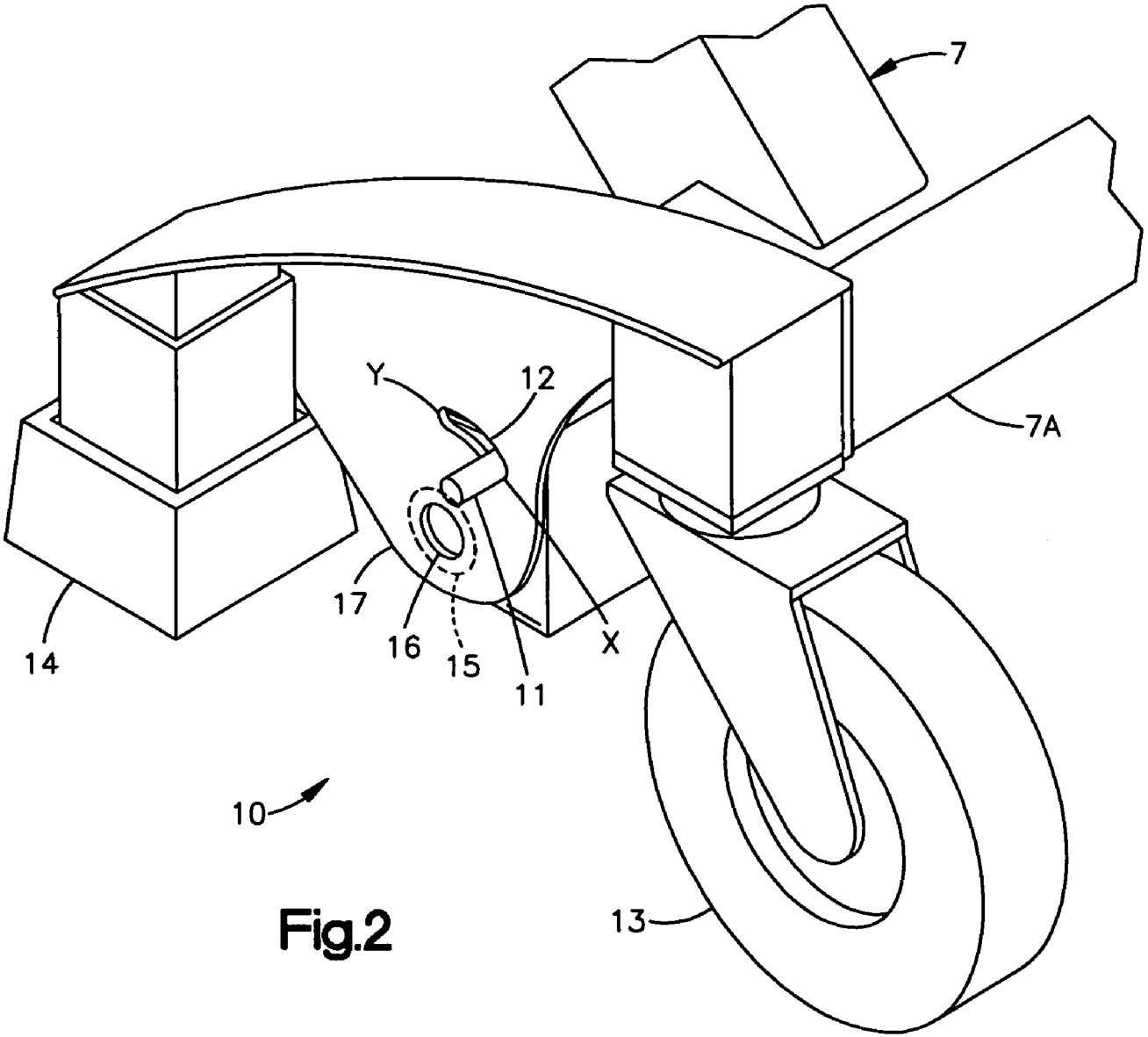
FIG. 2 is a perspective partly sectional view of the foot/caster leg arrangement.
Figure 3:
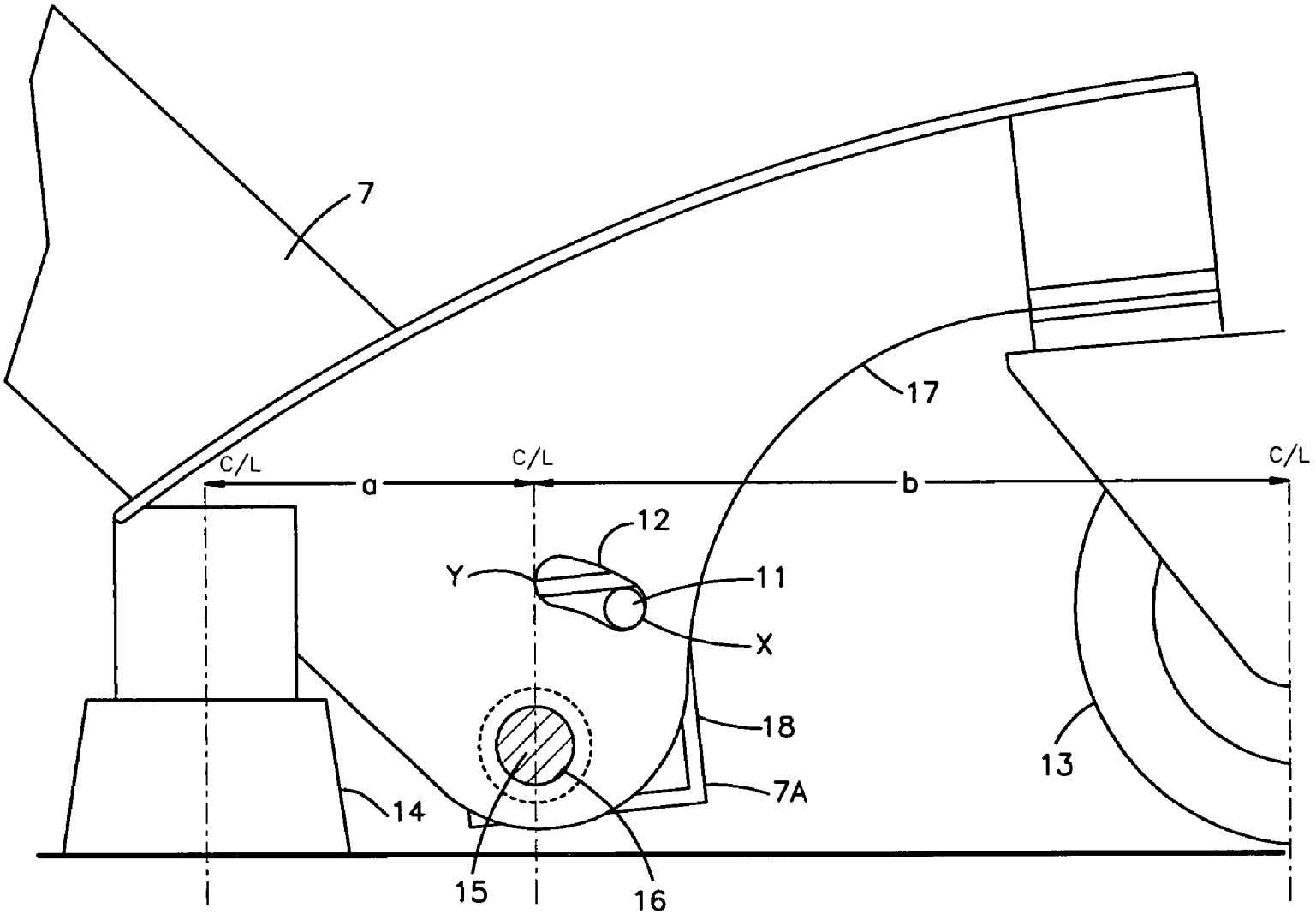
FIG. 3 is a side, partly sectional view, of the foot/caster leg arrangement.

The operation of the special foot/caster leg arrangement will now be described with reference to FIGS. 2 and 3. It can be seen that each open end of the U shaped main leg frame member 7 is connected by a rigidly attached horizontal cross frame member 18. According to this invention, a foot/caster leg is rotationally or pivotally attached at each end of cross member 18 by means of a shoulder bolt (non shown) passing through hole 16 in the flange 17 to which the foot 14 and caster 13 are attached at either end. As such, and with reference to FIG. 3, the center line of the caster 13 is distance B from the center line passing through the shoulder bolt. The center line of the foot 14 is distance A from the center line passing through the pin 15. The caster and foot are thus separated from one another by a ratio of B:A. Further operation of the foot/caster leg arrangement is now described.

As the bed is lowered or raised, a dog or pin 11 which is fixedly attached and outwardly extends from each end of the cross leg member 18, will move in an arcuate fashion by reason of its off center location with reference to the longitudinal center line of the cross member 18. The arcuate movement of the dog or pin 11 is achieved as a function of rotation of the main leg frame member 7. The dog or pin 11 is aligned and constrained within an arcuate slot 12 in the flange. Thus, and with reference to FIG. 3, when the bed as in the example shown is in its upper most position, the dog 11 will have moved clockwise in the arcuate slot 12 to the position shown in 3, thus engaging the flange at the point of contact X as shown. Further movement of the dog as the bed is raised causes the flange to rotate in a clockwise direction onto the caster wheel. Correspondingly, the foot will come off the ground. The reverse action will cause the dog 11 to rotate counter clock wise within the arcuate slot 12 ultimately into disengagement with the end of the slot X and towards the other end of the slot Y wherein the foot will fully engage the floor. It is the constraint of the dog within the arcuate slot which ensures that, excepting only one intermediate position, only the leg or caster are in contact with the floor but not both. It can be seen that the pivot distances B and A (ratio B:A) shown in FIG. 3 can be geometrically matched and sized to the length of the arcuate slot 12 to ensure that the foot 14 comes off the floor at or about the uppermost travel position of the bed. Further movement of the bed to its highest position causes the foot/caster leg to pivot to fully engage the caster wheels with the floor. Thus, the bed remains fixed on the ground through most of the vertical travel sequence.

The particular arrangement shown for the pin is not essential. What is important is to use the rotational motion at the bottom of the leg or horizontal base frame member by some means such as a pin to engage one end of a slot or channel to obtain the desired action. As such, the pin can be made to extend upwardly at right angles to the longitudinal axis of the horizontal base frame member and the foot/caster can be adapted with an interior channel within which the pin can move to engage one end of the channel.

A second foot/caster leg on the other end of cross member 18 operates in the same identical fashion but in reverse with respect to the description of the clock wise and the counter clock wise travel directions of the dog 11 within the arcuate slot 12. Obviously, the other main leg frame is equipped identically and operates in an identical and complementary fashion. All of the actions are synchronized to achieve the objects of this invention. As well, the foot caster may be optionally attached to the bottom of the leg and made to function in like fashion.

From the foregoing, it will be seen that this invention is one well adapted to attain all the ends and objects hereinabove set forth together with other advantages which are obvious and which are inherent to the structure.

It will be understood that certain features and sub-combinations are of utility and may be employed without reference to other features and sub-combinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

The invention claimed is:

1. A bed, having a bed frame and a pair of motor powered leg means operable to vertically raise and lower the bed frame between a lowermost and an uppermost position, the leg means including rolling means, the rolling means comprising a leg member and a pivot means connected to the leg member, the leg member pivoting for engaging the floor when the bed frame is in the lowermost position and disengaging the floor when the bed frame is raised to thereby render the bed horizontally mobile on the rolling means only at substantially the uppermost position.

2. A bed as set forth in claim 1 wherein the leg member is a foot and the rolling means includes a roller, the pivot means supporting the foot and the roller for pivotal movement.

3. A bed as set forth in claim 2 wherein the foot and the roller are connected for movement by a flange, the flange being supported for pivotal movement to provide the pivoting movement of the leg member.

4. A bed for use on a floor, comprising: a bed frame;

first and second legs disposed at opposite ends of the bed that support the bed frame for vertical movement relative to the floor between an uppermost position and a lowermost position and a plurality of intermediate positions including an upper intermediate position;

each one of the first and second legs having a respective upper end portion movably connected to the bed frame and having a respective lower end portion that includes a wheel and a foot, the lower end portion being movable vertically relative to the bed frame upon movement of the leg relative to the bed frame;

each one of the lower end portions of the legs including a leg member and a support member that is rockably connected to the leg member at an attachment point, the foot and the wheel being supported on the support member on opposite sides of the attachment point for rocking movement with the support member;

wherein the support member is a flange that supports the foot and wheel at opposite ends of the flange, the flange being pivotally mounted to a leg member.

5. A bed for use on a floor, comprising:

a bed frame;

first and second legs disposed at opposite ends of the bed that support the bed frame for vertical movement relative to the floor between an uppermost position and a lowermost position and a plurality of intermediate positions including an upper intermediate position;

each one of the first and second legs having a respective upper end portion movably connected to the bed frame and having a respective lower end portion that includes a wheel and a foot, the lower end portion being movable vertically relative to the bed frame upon movement of the leg relative to the bed frame;

each one of the lower end portions of the legs including a leg member and a support member that is rockably connected to the leg member at an attachment point, the foot and the wheel being supported on the support member on opposite sides of the attachment point for rocking movement with the support member;

wherein the upper end portions of the legs are movably connected to the bed frame to slide longitudinally along the length of the bed frame during raising and lowering of the bed.

6. A bed for use on a floor, comprising:

a bed frame;

first and second legs disposed at opposite ends of the bed that support the bed frame for vertical movement relative to the floor between an uppermost position and a lowermost position and a plurality of intermediate positions including an upper intermediate position;

each one of the first and second legs having a respective upper end portion movably connected to the bed frame and having a respective lower end portion that includes a wheel and a foot, the lower end portion being movable vertically relative to the bed frame upon movement of the leg relative to the bed frame;

each one of the lower end portions of the legs including a leg member and a support member that is rockably connected to the leg member at an attachment point, the foot and the wheel being supported on the support member on opposite sides of the attachment point for rocking movement with the support member;

wherein the foot pivots relative to the bed frame when moving into and out of engagement with the floor.

7. A bed for use on a floor, comprising:

a bed frame;

first and second legs disposed at opposite ends of the bed that support the bed frame for vertical movement relative to the floor between an uppermost position and a lowermost position and a plurality of intermediate positions;

each one of the first and second legs having a respective upper end portion that is movably connected to the bed frame for longitudinal movement along the bed frame and having a respective lower end portion that includes a wheel and a foot, the lower end portion being movable vertically relative to the bed frame upon longitudinal movement of the upper end portion of the leg relative to the bed frame;

the wheels of the first and second legs engaging the floor when the bed frame is in the uppermost position and being spaced upward from the floor when the frame is in the lowermost position; and the feet of the first and second legs engaging the floor when the bed frame is in the lowermost position and in the plurality of intermediate positions;

wherein the vertical movement of the lower end portions of the legs and the longitudinal movement of the upper end portions of the legs effects vertical movement of the bed frame without longitudinal movement of the bed frame.

8. A bed as set forth in claim 7 wherein at least one end portion of each one of the first and second legs moves longitudinally when the bed frame moves vertically.

9. A bed as set forth on claim 7 wherein the feet of the first and second legs pivot when moving into and out of engagement with the floor.

10. A bed that can be supported on a floor, having a bed frame and a pair of legs at opposite ends of the bed frame for vertically raising and lowering the bed frame between a lowermost position and an uppermost position, each one of the legs including a leg member and a rolling member, the leg members engaging the floor when the bed frame is in the lowermost position and disengaging the floor when the bed frame is raised to thereby render the bed horizontally mobile on the rolling members only at substantially the uppermost position.

11. A bed as set forth in claim 10 wherein the leg members pivot when moving into and out of engagement with the floor.

12. A bed as set forth in claim 10 wherein each leg includes a pin and slot arrangement that causes the leg members to pivot out of engagement with the floor only when moving into substantially the uppermost position.

* * * * *